US005988642A

United States Patent [19]

Ziemba et al.

[11] Patent Number: 5,988,642

[45] Date of Patent: Nov. 23, 1999

[54] SAFETY BOARD GAME

[76] Inventors: Michael Ziemba; Barbara M. Ziemba, both of 3732 East Ave., Berwyn, Ill. 60404

[21] Appl. No.: 09/035,082

[22] Filed: Mar. 5, 1998

[51] Int. Cl.[6] ..... A63F 3/00

[52] U.S. Cl. ..... 273/251; 273/254

[58] Field of Search ..... 273/251, 252, 273/254, 248, 249, 243, 242

[56] References Cited

U.S. PATENT DOCUMENTS

| | | | |
|---|---|---|---|
| 1,085,371 | 1/1914 | Watterson | 273/251 |
| 1,524,740 | 2/1925 | Lorenz | 273/251 |
| 1,534,591 | 4/1925 | Hodges | 273/251 |
| 1,544,254 | 6/1925 | May et al. | 273/251 |
| 1,550,190 | 8/1925 | Warner | 273/251 |
| 1,551,951 | 9/1925 | Haibloom et al. | 273/251 |
| 1,562,778 | 11/1925 | McGowan | 273/251 |
| 4,094,510 | 6/1978 | Drohomirecky | 273/251 |
| 5,139,266 | 8/1992 | Mullins et al. | 273/251 X |
| 5,314,188 | 5/1994 | Mason et al. | 273/251 |
| 5,810,358 | 9/1998 | Manson | 273/251 |
| 5,813,671 | 9/1998 | Barratt | 273/251 |
| 5,826,877 | 10/1998 | Glassman | 273/251 X |

OTHER PUBLICATIONS

Pp. 187–188, Official Gazette (patents) of Nov. 4, 1997.

*Primary Examiner*—Sebastiano Passaniti

*Attorney, Agent, or Firm*—Joan I. Norek; The Law Office of Joan I. Norek

[57] ABSTRACT

A board game apparatus is provided for instructing game participants on safety rules and regulations comprising a game board, at least one game marker, at least one marker-movement chance device and at least one stop-or-go chance device. The game board has a playing surface, which can be its upper surface, that has a plurality of domains delineated at least by outline demarcations. The domains include at least one hazard domain and at least one journey domain. The journey domain is comprised of a succession of spaces having a beginning and an end. The hazard domain comprises a hedged-hazard region that includes at least one hazard space immediately preceded by a stop-or-go security space that contains a representation of a stop-or-go safety regulation.

13 Claims, 8 Drawing Sheets

SAFETY BOARD GAME

BACKGROUND OF THE INVENTION

The present invention is in the field of board games, particularly board games to be played by children. The board game of the present invention is devised to develop, exercise and test a player's perception and awareness of safety hazards and precautionary steps and maneuvers.

BRIEF SUMMARY OF THE INVENTION

The present invention is a board game apparatus and method of play that develop, exercise and test a player's perception and awareness of safety hazards, safety rules and precautionary steps and maneuvers. The board game apparatus comprises a game board, at least one game marker, at least one marker-movement chance means and at least one stop-or-go chance means. The game board has a plurality of domains that include at least one journey domain comprised of a succession of spaces on which a game marker is moved. The domains also include at least one hazard domain having a hazard space immediately preceded by a security space that contains a representation of a "stop-or-go" type of safety regulation. The "stop or proceed" dictate of the safety regulation, such as a stop sign or a traffic light, is determined by operation of the stop-or-go chance means.

DETAILED DESCRIPTION OF THE INVENTION

Figure 1:
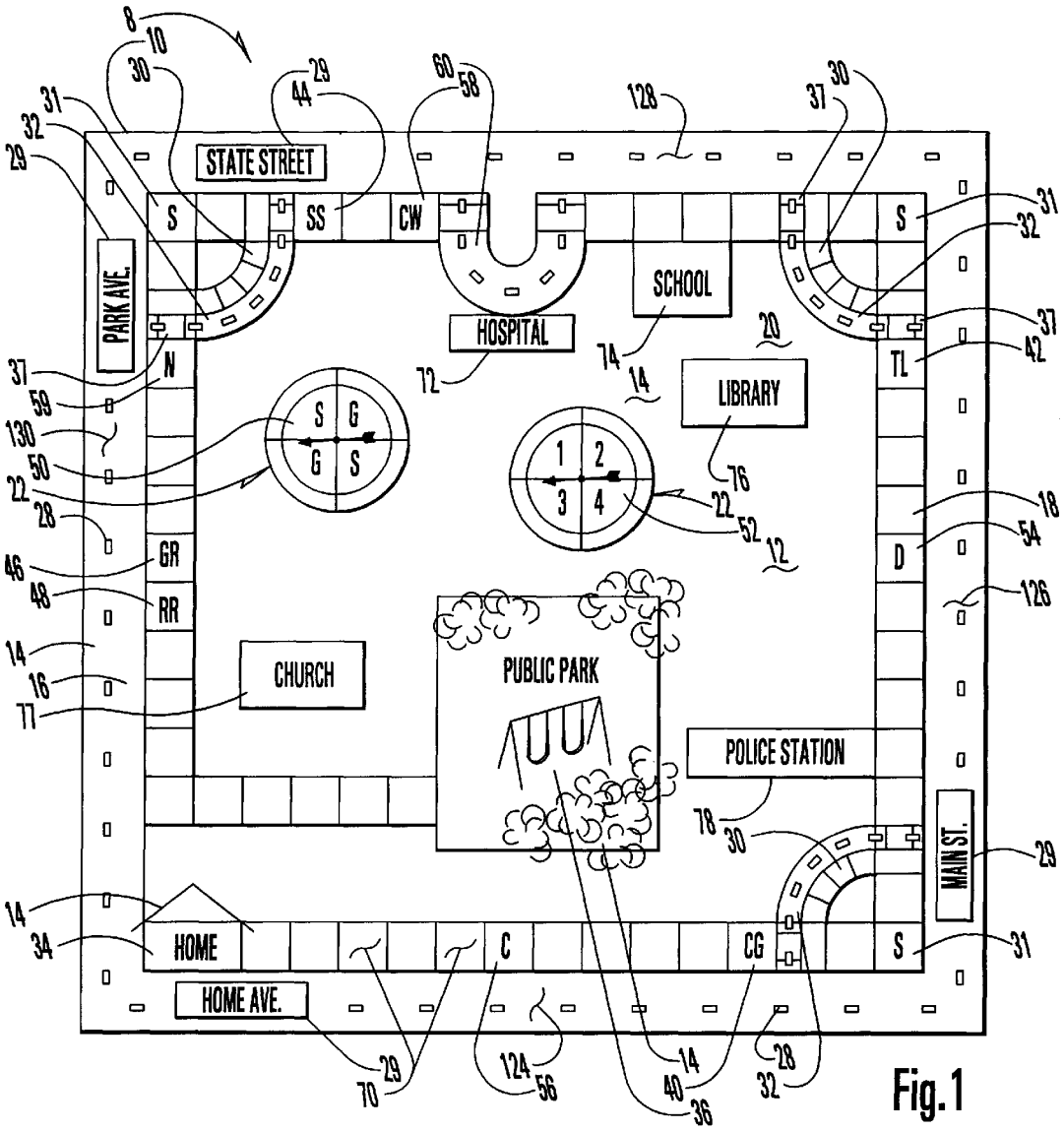
FIG. 1 is a plan view of a board game apparatus of the invention.

The game's underlying purpose or intangible objective is to instruct the participants or players in prudent safety rules and regulations by levying penalties and/or conferring awards. Penalties generally hinder a participant's progress, while awards advance a participant's progress towards a game win or victory.

The game's primary tactile objective is to advance a marker from a start or embarkment region along a journey route or region, to a finish or destination region. A reward might move the participant forward towards the destination or provide an extra turn for so advancing. A penalty might move the participant backwards, or impede or delay the participant's forward progress. These rewards and penalties are described and illustrated in detail below.

The embarkment region is the departure station or beginning point of the game and the destination region is the game's conclusion. The embarkment and destination regions are preferably coupled to delimit and/or define the journey traveled between these regions. Together they preferably at least partially set the geographic environment of the journey, which in turn preferably influences the choice of safety hazards that are included along the route. For instance, "home" could be selected as either an embarkment or destination region. Coupling "home" in either functional role with a "park", "playground", "school", "friend's home" and the like would be suitable for younger children, being exemplary of journeys undertaken at a young age. Again using "home" as either an embarkment or destination region, for older children it might be coupled with a "movie theater", "ballpark", "supermarket" or the like. While older children also travel between home and school, for instance, the game's instructional value is enhanced by choosing ajourney that replicates new experiences for the target age group. The selection of "home" as either the embarkment or destination region is of course not mandatory, and instead a journey could be between "school" and a "friend's house", between a "ballpark" and a "supermarket" and the like.

The age-based distinctions in the selection of the game's journey may be related to the "distance" between the embarkment and destination regions as reflected in the type of safety hazards positioned along the route. For a younger child a street to be crossed would be a common, but significant, safety hazard encountered on the way to school. Older children often travel farther to school, encountering different and possibly more dangerous hazards, for instance railroad crossings.

Hazard regions generally are areas that represent or symbolize actual safety risks, which preferably are safety risks routinely encountered for a given journey theme. Hazard regions fall within two broad categories, namely neighboring hazard regions and intersecting hazard regions, each of which is described in more detail below.

Neighboring hazard regions might be similar to intersecting hazard regions as to the character of the risk, but they do not intersect the journey's route and thus would be passed rather than encountered in the normal course of play. They might demonstrate the reason the journey's route is confined to path of the journey route, and/or represent a more serious hazard than an intersecting hazard. The neighboring hazard regions are positioned to the side of the journey's route. For instance, a neighboring hazard might be a street paralleling a portion of the route. A neighboring hazard can be combined with one or more intersecting hazards of related or dissimilar natures.

Intersecting hazard regions are positioned within or across the journey's path. An intersecting hazard region can be an avoidable hazard region, a hedged hazard region and/or a bare hazard region, which are described in more detail below. An intersecting hazard is encountered by a participant when their marker stops or lands on or within the hazard region.

The game may have a plurality of intersecting hazard regions, which may be of the same type or of different types, or combinations thereof. The relative risks between two or more different intersecting hazards may be reflected in differences between the penalties each carries, a more serious intersecting hazard bearing a greater penalty.

Avoidable hazard regions are those that can be bypassed by following an alternative path or detour route. Preferably they depict hazards that should be avoided, if possible, in actual journeys. Preferably they always carry a penalty when encountered, and the penalty structure and rules can follow that of bare hazard regions, discussed below, or differ therefrom. Avoidable hazard regions comprise one or more adjacent hazard spaces. Preferably the alternate route is longer but contains no intersecting hazards or instead contain less serious intersecting hazards. There may be more than one alternative route bypassing any given avoidable hazard region or groups of avoidable hazards. Appropriate avoidable hazard regions could include strangers, alleys, unsupervised dogs, highways and the like.

A hedged hazard region is comprised of a hedged-hazard space and at least one preceding security or safety-regulation space. In one embodiment of the present invention, a stop-or-go security space cannot be avoided (passed by or over) regardless of how many spaces allotted to the player's marker in that turn, without first stopping on the stop-or-go security space. In alternate embodiment a player receives a serious penalty if the marker is not stopped at the stop-or-go security space. When a marker is on a stop-or-go security space, a player must determine whether or not they can continue by drawing a card or spinning a wheel or throwing one or a plurality of dice, or using some other stop-or-go chance means. This determination occurs in a safety-regulation turn, which can immediately follow the stop on the stop-or-go security space or be a substitute for the player's next regular turn. In preferred embodiment the safety-regulation turn reflects a safety regulation associated with the hedged hazard. For instance, if the hedged hazard is an intersecting street, the stop-or-go security space might contain or represent a traffic light, and the safety-regulation turn will determine whether the light is red or green. If the light is green, the marker can be moved the spaces remaining for the player's turn or alternatively the player can be awarded an additional turn. If the safety regulation dictates against forward movement, for instance if the traffic light is red, the marker remains on the stop-or-go security space until the player's next turn. Other appropriate safety regulations associated with intersecting streets include stop signs and/or crossing guards. If for instance the hedged hazard is a railroad crossing, the safety-regulation turn will determine whether, for a given player and turn, the crossing guard gate is up or down. There may be separate stop-or-go chance means for taking each type of safety-regulation turn or a plurality of types may be combined. The stop-or-go chance means may include illustrations or other representations of red and green traffic lights for the traffic light hazard example above, and with up and down crossing guards for the railroad crossing example above. The stop-or-go chance means may indicate whether or not to proceed for a plurality of kinds of hedged hazard regions, and could so indicate with merely the words "stop" and "go".

Preferably a player should never land on a hedge-hazard space itself. When the player has a right to move forward from the stop-or-go security space, the hedged-hazard space could be treated as a "free" space, that is one that is not counted. Alternative, the participant's marker could be held up on the stop-or-go security space until the player's turn permits it to fully cross over the hedge-hazard space. Another alternative is to exclude the possibility that the number of spaces to be moved in one turn is only one space. The last-mentioned alternative could be provided by the use of a spinner having no "1" as the marker-movement chance means.

When the rules are structured so that a loss of a portion of a turn might occur when a player's marker is halted at a hedged hazard region, this impedance of forward movement is not to be considered a penalty, but instead it can be considered an inevitable inconvenience. The stop on the stop-or-go security space of each hedged hazard region is required of all players, unless a detour or bypass is provided as discussed below.

A bare hazard region is comprised of one or more adjacent hazard spaces that (1) are not avoidable by an alternate path and (2) do not include the combination of a stop-or-go security space preceding a hedged-hazard space. The rules might dictate a penalty when a marker lands on any of the hazard spaces within a bare hazard region. Alternatively the rules may provide that the marker must be stopped on the first hazard space within a bare hazard region, whereby any remaining spaces in that turn are lost. In the latter alternative, the rules might also require that the marker is not moved on the next turn unless the spaces picked up in that turn permit all subsequent hazard spaces in that bare hazard region to be cleared.

The game of the present invention also preferably includes safe behavior regions, which provide a benefit or reward to the player. They embody behaviors that a child should be following in actual journeys. The game may have a plurality of safe behavior regions, which may be of the same type or of different types, or combinations thereof. Safe behavior regions comprise one or more adjacent spaces. The reward is secured merely by landing on a space within the region. The reward might be a free turn or a movement forward a set number of spaces. If there is more than one space in a given safe behavior region, the spaces could have the same or different rewards.

The game of present invention preferably also includes one or more safe behavior sections which each comprises only a part of a space. The safe behavior section may be located on a hazard space, for instance, a crosswalk on a street hazard space, which street hazard space might be within a hedged hazard, an avoidable hazard or a bare hazard region. A safe behavior section differs from a safe behavior region in that the marker is required to be placed on that section of the space in order to earn a reward. The rules might provide that a space having such a section can be passed by in a given turn, but a reward might be given for the marker staying within the section when passing by, and/or a penalty might be levied for not staying within the section when passing by.

Detour routes bypass one or more hazard regions and/or safe behavior regions. Preferably the detour routes are longer than the path they bypass in order to teach that some inconvenience is the price of safety. The detour routes around safe behavior sections and safe behavior regions, however, might be shorter than the path that is bypassed. Among numerous possible combinations are having a detour route bypassing a hazard region that includes a lesser hazard or a safe behavior region or a hazard with a safe behavior section.

The elements of the game of the present invention permit elections and combinations from which innumerable embodiments can be produced. Some of the elections and/or combinations will be established by the rules selected.

Referring to FIG. 1 there is shown in partial diagrammatic form a board game apparatus, designated generally by the reference numeral 8, within the present invention and on which the method of the present invention can be played. The board game apparatus includes a game board 10 which, as shown, is a substantially rigid member having a substantially flat playing surface 12 having a substantially square shape. The game board 10 can be constructed so as to fold into a smaller size, for instance in half, or to comprise a section of a box containing the board game apparatus in its entirety. As shown the game board 10 is laid out open or substantially flat.

On the playing surface 12 are displayed representations of a multiplicity of domains, designated generally by the reference numeral 14. The domains 14 on the board game 10 are generally delineated by outline demarcations on the board's playing surface 12, and the domains 14 can be identified and distinguished by location, configuration, color and/or illustration or pattern at least partially encompassed therein. The domains 14 arrayed on the playing surface 12 of the game board 10 include a hazard domain 16, a journey domain 18, an environs domain 20, and a plurality of spinner domains 22. The hazard domain 16 comprises a plurality of streets that both form neighboring hazards (through the streets forming a perimeter border) and form intersecting hazards in part.

The neighboring hazard that forms a border comprises four perimeter street areas, namely, a first, a second, a third and a fourth street 124, 126, 128, 130 each extending separately along and adjacent to an edge of the game board 10, intersecting at the corners. Each of the streets 124, 126, 128, 130 have been given a street name, which names are displayed on street signs 29 positioned at or near the street intersections. Where convenient, the streets 124, 126, 128, 130 are identified herein by a street name. The first street 124, named Home Ave., intersects with the second street 126, named Main St., which at its opposite end intersects with the third street 128, named State St., which at its opposite end intersects with the fourth street 130, named Park Ave. Park Ave. 130 in turn intersects with Home Ave. 124. The four streets 124, 126, 128, 130 together form a continuous border on the playing surface 12 of the game board 10. As illustrated, the four streets 124, 126, 128, 130 mimic actual streets by a pattern comprised of an intermittent center lines 28. The four perimeter streets mimic a grid layout of streets such as the street grids routinely found in urban areas. Such a grid of streets comports with an urban environs and enhances the representation of an urban environment by the domains 14 employed in combination.

The journey domain 18 is comprised of a plurality of individual blocks or spaces that include several bypass routes and are intersected by several hazards. The path formed by these spaces begins at an embarkment domain 34 (described below), extends along and adjacent to Home Ave. 124, turns left at the first corner, continues along the side of Main St. 126, turns left at the second corner, continues along and parallel to State St. 128, again turns left at the third corner, and continues partially along the extent of Park Ave. 130, turning left again before it reaches the fourth corner, ending at a destination domain 36. The journey domain also includes three bypass routes 30 circumventing respectively the first, second and third corners. The blocks or spaces of the journey domain 18 are functional game spaces that are counted off for each player's turn, and mimic sidewalk spaces. The game depicted in FIG. 1 mimics an urban journey with urban types of hazards.

The bypass routes 30 are each one space longer than the direct-route spaces that they bypass. The first and third corners each contain an intersecting hazard region, that is, an avoidable hazard designated by the letter "S" for "stranger" that are each contained in an avoidable hazard space 31, which represents the peril of a close approach by or to an unknown person. Any or all of these corners can be avoided by selecting the respective bypass route 30, which bypass routes lie adjacent and follow secondary streets 32.

Each of the secondary streets 32 is curved and extends from one of the perimeter streets to the next one and thus each secondary street 32 intersects the path twice. At each of the six locations where a secondary street 32 intersects the path, the secondary street 32 is bridged with a crosswalk 37 delimited by a pair of cross walk lines. A U-shaped driveway 60, jutting from State Street, also intersects the path and also is bridged by a cross walk 37.

The secondary streets 32 and driveway 60 are all illustrated employing roadway center lines 28, in substantially the same style as the perimeter streets. The lines of the driveway 60 are not, however, centered but instead follow the somewhat semicircular vehicle path.

Three of the spaces immediately before crosswalks 37, designated respectively spaces 40, 42 and 44, are stop-or-go security spaces. Each of these security spaces in combination with the following intersecting hazard space formed by the secondary street, constitute a hedged hazard region. Security space 40 contains a crossing guard designated by the letters "CG". The second stop-or-go security space 42 contains a traffic light designated by the letters "TL". The third stop-or-go security space 44 contains a stop sign designated by the letters "SS". A fourth stop-or-go security space 46 is positioned along Park Avenue and immediately precedes a hazard space 48 with a railroad track designated "RR" that intersects the path. This fourth stop-or-go security space 46 contains a guard rail designated "GR". Rules can provide for playing each of these four types of hedged hazards the same or differently. For example, if a participant passes by any of the security spaces, the rules can require that the marker be returned to the stop-or-go security space or moved back a certain number of spaced. As discussed below, the game illustrated in FIG. 1 permits a maximum move of four spaces per turn. A severe penalty of moving the marker back seven or eight spaces could be levied for passing a stop-or-go security space. When stopped on any of the security spaces, the rules could provide that the participant determine whether to proceed or not either immediately or at the participant's next turn. The stop-or-go chance means for determining whether to remain or proceed in the game illustrated in FIG. 1 is a stop-or-go spinner 50. The participant spins the spinner 50, and proceeds if the spinner's arrow stops at "GO"(shown in FIG. 1 as "G") and the participant remains if the arrow stops at "STOP"(shown in FIG. 1 as "S"). The second spinner 52 is a marker-movement chance means that determines how many spaces should be moved in a participant's turn. The second spinner is labeled from one to four. Since preferably a player should never land on a hedge-hazard space, and its next turn when on a stop-or-go security space might be to move just one space, the adjacent hedged-hazard space could be treated as a "free" space or as an area that does not constitute a game space. Another rule alternative is that when the participant may proceed but spins a "one", the marker must remain on the stop-or-go security space until a higher number of spaces is obtained in a regular turn, with or without redetermining whether to remain or proceed.

The path along Main St. 126 includes a bare hazard region space 54 that contains the letter "D" for a "beware of dog". The penalty for a participant landing upon this space could be moving the marker back for instance two spaces, and could be specified within the space. The path along Home Avenue includes a safe behavior region space 56 that contains the letter "C" for "did not step off the curb". The reward for a participant landing upon this space could be moving the marker ahead for instance two spaces, and could be specified within the space.

The rules could provide a penalty when a participant does not place its marker within the crosswalks 37 when passing by an intersecting secondary street or the driveway, and/or a reward for placing the marker within those lines. Alternatively an intersecting secondary street and the space immediately beyond it could constitute a safe behavior region or a bare hazard region with a reward or penalty indicated on the space beyond. This is illustrated by a safe behavior region along State Street that includes the safe behavior space 58 which contains the letters "CW" for "did stay between crosswalk lines", and by a bare hazard region along Park Avenue that includes the bare hazard space 59 and contains the letter "N" for "did not stay between crosswalk lines". The reward and penalties again could be moving forward or back a certain number of spaces, or alternatively taking an extra turn or losing the next turn.

Also shown in FIG. 1 are a plurality of game markers 70 and environs domain particulars including a hospital 72, a school 74, a library 76, a church 77 and a police station 78.

The embarkment domain 34 symbolizes the home of each player. The play starts with all of the players markers on this embarkment domain 34.

To illustrate the game play of the embodiment of Example 1 in more detail, the following are excerpts of an imaginary single-player game. The players spins the marker-movement spinner 52, the needle of which stops over the section marked "2" and the marker is moved two spaces. On the second spin the needle stops over "4" and the marker is moved forward four spaces to the "did not step off the curb" safe behavior region space 56. Having encountered the safe behavior region space 56 by landing on the space, the player receives the indicated reward which is to move the marker forward two spaces. On the third spin the needle stops over 2 and the marker is moved two spaces forward, On the fourth spin the needle stops over "4", but instead of moving forward four spaces the marker must stop at the space which contains a crossing-guard, space 40, which is a stop-or-go security space, and spin the stop-or-go spinner 50 to see if it can proceed. It is determined that the marker can proceed and on the fifth turn the marker is moved two spaces to the space preceding the avoidable hazard space 31. On the sixth turn the marker must move one space, onto the avoidable hazard space 31, and there is required to move back four spaces at which position the player must stop on its next turn at the same stop-or-go security space 40. Later the marker lands on the "beware of dog" bare hazard region space 54 and is required to move back two spaces. Later when the marker is permitted to move off the stop-or-go security space 42 the longer detour route 30 is chosen rather than risking an encounter with the avoidable hazard space 31. While moving along State Street 128 the marker lands on the "did stay within the crosswalk lines" safe behavior space and receives a reward of advancing two spaces onto the "stop sign" stop-or-go security space 44, at which space the marker would have been stopped on the next turn anyway. Eventually the marker reaches the destination domain, the public park 36.

Figure 2:
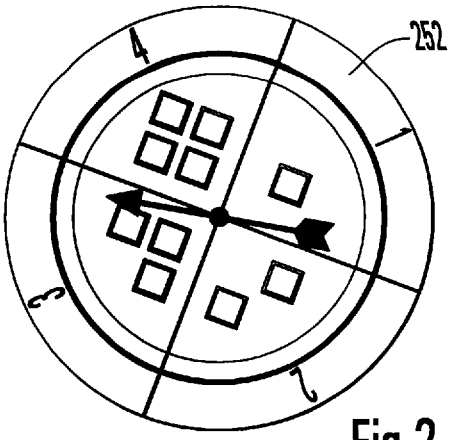
FIG. 2 is a plan view of a spinner domain of a board game apparatus of the invention.
Figure 3:
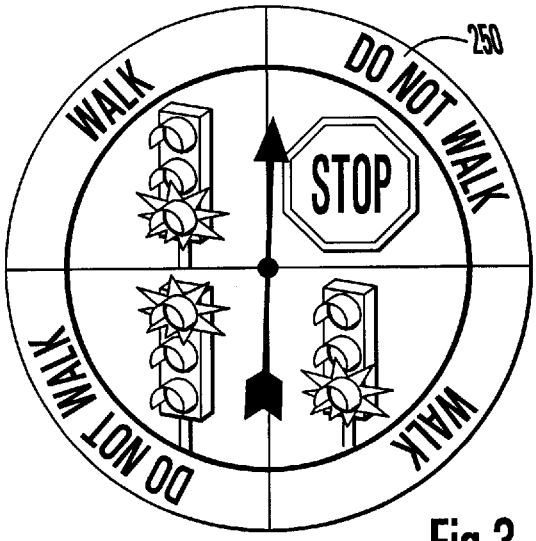
FIG. 3 is a plan view of a spinner domain of a board game apparatus of the invention.
Figure 4:
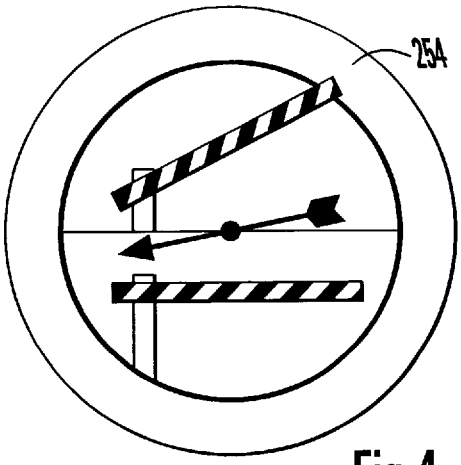
FIG. 4 is a plan view of a spinner domain of a board game apparatus of the invention.
Figure 5:
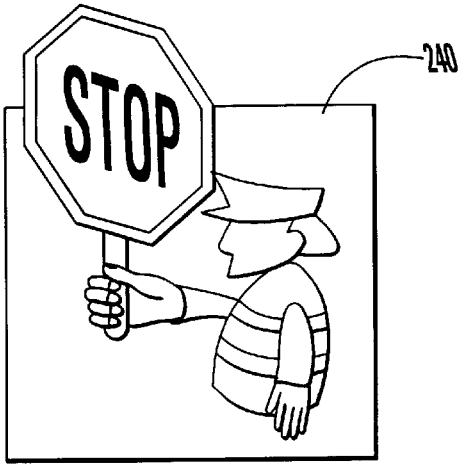
FIG. 5 is a plan view of a stop-or-go security space of a board game apparatus of the invention.
Figure 6:
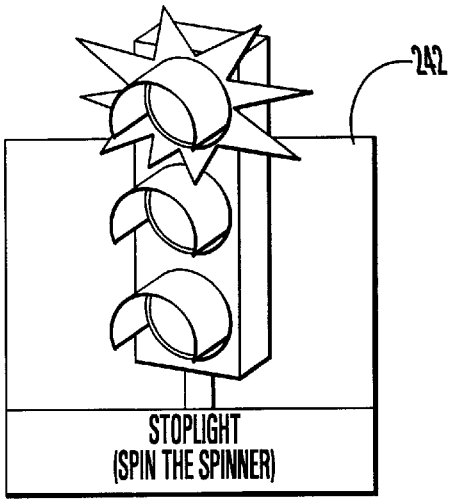
FIG. 6 is a plan view of a stop-or-go security space of a board game apparatus of the invention.
Figure 7:
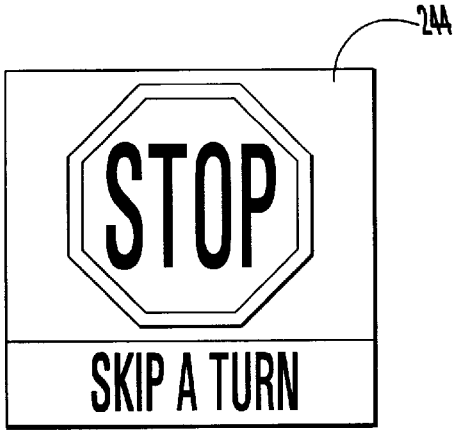
FIG. 7 is a plan view of a stop-or-go security space of a board game apparatus of the invention.
Figure 8:
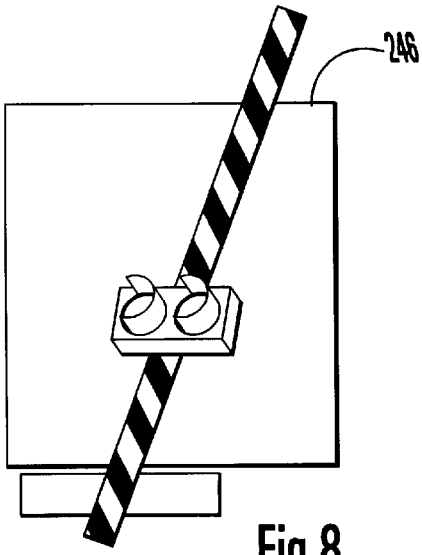
FIG. 8 is a plan view of a stop-or-go security space of a board game apparatus of the invention.
Figure 9:
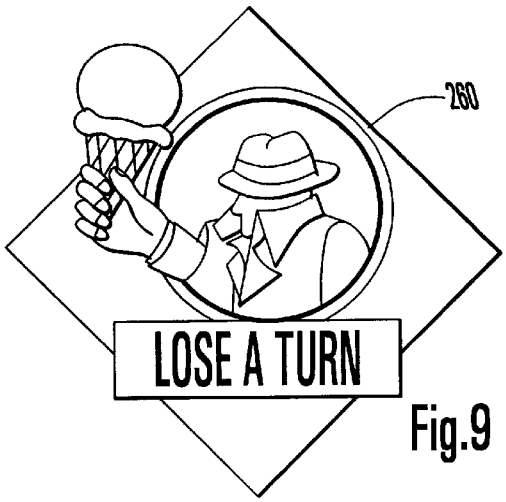
FIG. 9 is a plan view of a hazard space of a board game apparatus of the invention.
Figure 10:
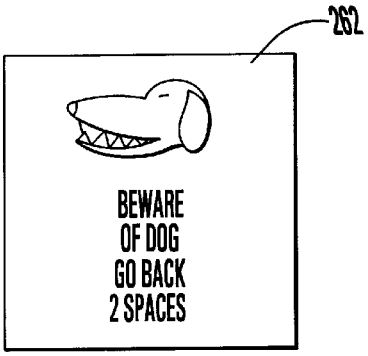
FIG. 10 is a plan view of a hazard space of a board game apparatus of the invention.
Figure 11:
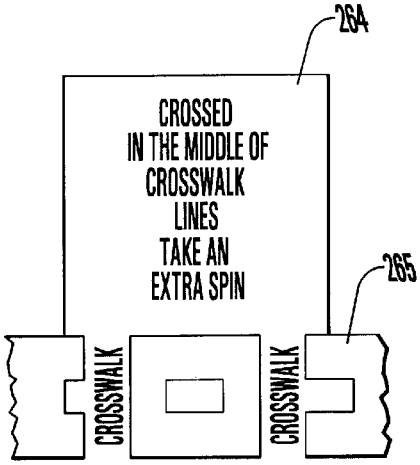
FIG. 11 is a plan view of a safe-behavior region space of a board game apparatus of the invention.
Figure 12:
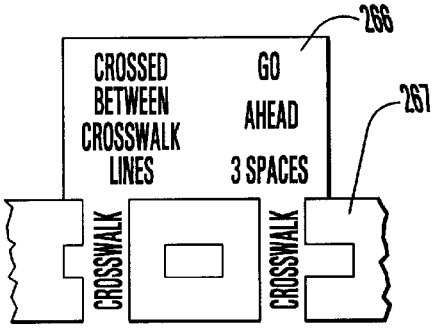
FIG. 12 is a plan view of a safe-behavior region space of a board game apparatus of the invention.
Figure 13:
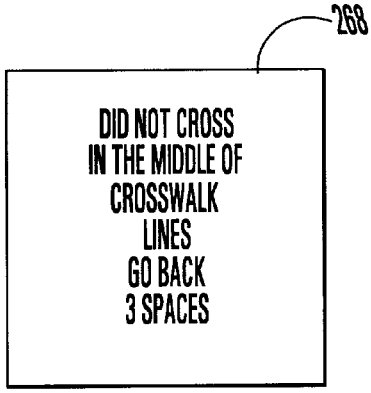
FIG. 13 is a plan view of a bare hazard region space of a board game apparatus of the invention.

The game may include simple or detailed illustrations and/or text and/or spinners beyond that shown in FIG. 1. Referring to FIG. 2 through FIG. 4, there are shown alternate and/or optional spinner domains. A marker-movement spinner 252 is shown in FIG. 2 that has both numbers and equivalent numbers of objects, shown there as squares. The marker-movement spinner 252 is divided into four sections labeled with the numbers 1 through 4, each section indicating the number of spaces a player should move her or his marker on a given turn. A marker-movement spinner could of course be divided into as many spaces as practical and/or be labeled with random numbers and/or have the numbers arrayed randomly. A stop-or-go spinner 250 suitable for use when a player takes a safety-regulation turn when halted by a traffic light or crossing guard is shown in FIG. 3. The stop-or-go spinner 250 is divided into four sections, two of which contain illustrations of green lights and two of which show a stop indicator, that is respectively a red light and a stop sign. In FIG. 4 is shown a stop-or-go spinner 254 that is suitable for use when a player is halted on a stop-or-go security space before a train track. The stop-or-go spinner 254 is divided into two sections, one of which contain an illustration of a raised guard rail and one of which shows a lowered guard rail.

In FIG. 5, 6, 7 and 8 there are shown illustrated versions of security spaces, respectively a crossing guard stop-or-go security space 240, a traffic light stop-or-go security space 242, a stop sign stop-or-go security space 244 and a guard rail stop-or-go security space 246. These illustrated versions can be substituted for their counterparts shown in FIG. 1.

In FIG. 9, 10, 11, 12 and 13 there are shown illustrated and/or textual versions of hazard and safe behavior region spaces representations that are respectively a "stranger" avoidable hazard region space 260, a "beware of dog" bare hazard region space 262, a "crossed-within crosswalk lines" safe behavior region space 264 in combination with a crosswalk-marked secondary street fragment 265, another version of a "did stay between crosswalk lines" safe behavior region space 266 in combination with a crosswalk-marked secondary street fragment 267, and a "did not stay between crosswalk lines" bare hazard region space 268 which for instance can be alternatives or substitutes for those of FIG. 1. Each of these hazard and safe behavior region spaces includes text that defines the penalty or reward.

Figure 14:
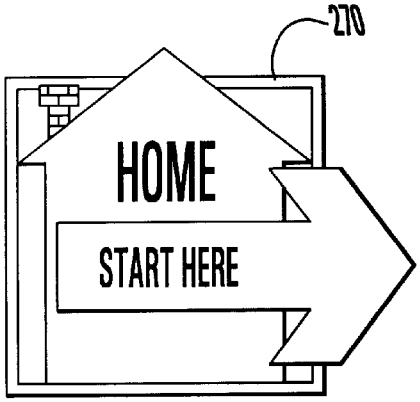
FIG. 14 is a plan view of a embarkment domain of a board game apparatus of the invention.
Figure 15:
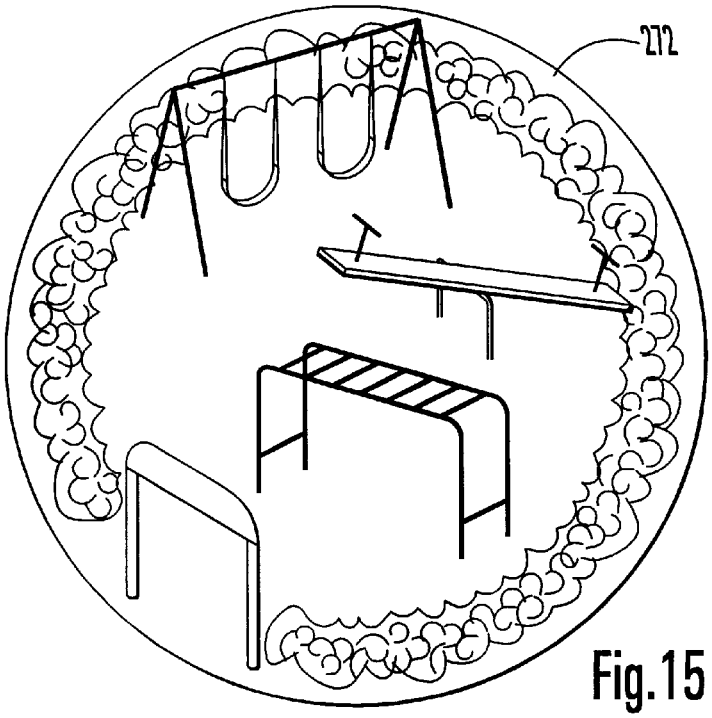
FIG. 15 is a plan view of a destination domain of a board game apparatus of the invention.

In FIG. 14 and 15 there are shown illustrated and/or textual versions of embarkment and destination domains, respectively an embarkment domain 270 and a destination domain 272 which for instance can be alternatives or substitutes for those of FIG. 1.

Figure 16:
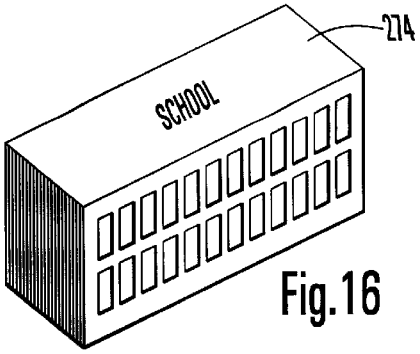
FIG. 16 is a plan view of a section of an environs domain of a board game apparatus of the invention.
Figure 17:
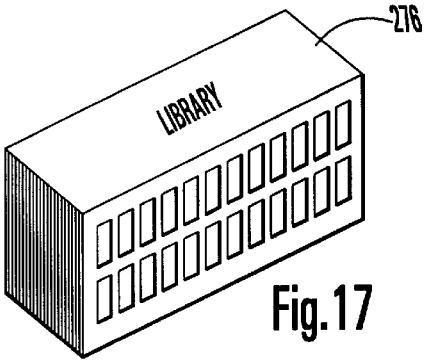
FIG. 17 is a plan view of a section of an environs domain of a board game apparatus of the invention.
Figure 18:
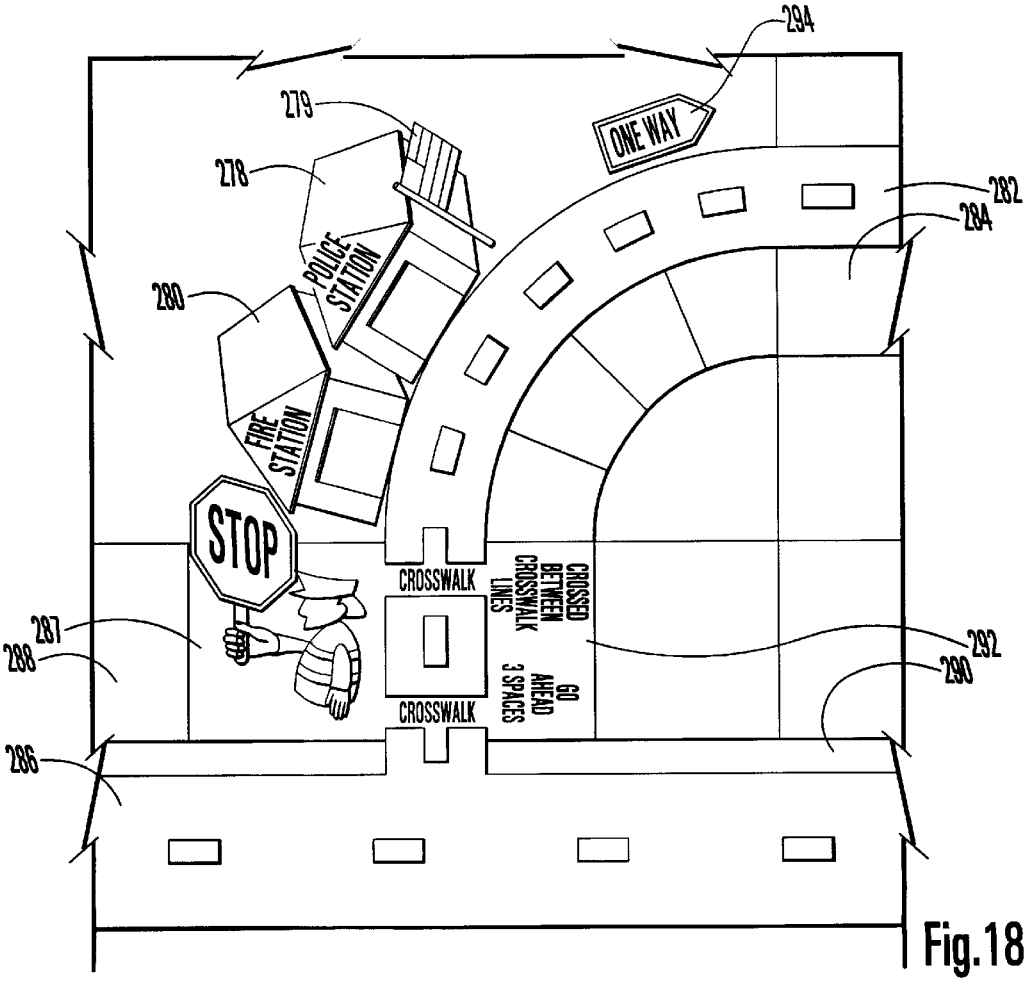
FIG. 18 is a plan view of a section of an environs domain of a board game apparatus of the invention.
Figure 19:
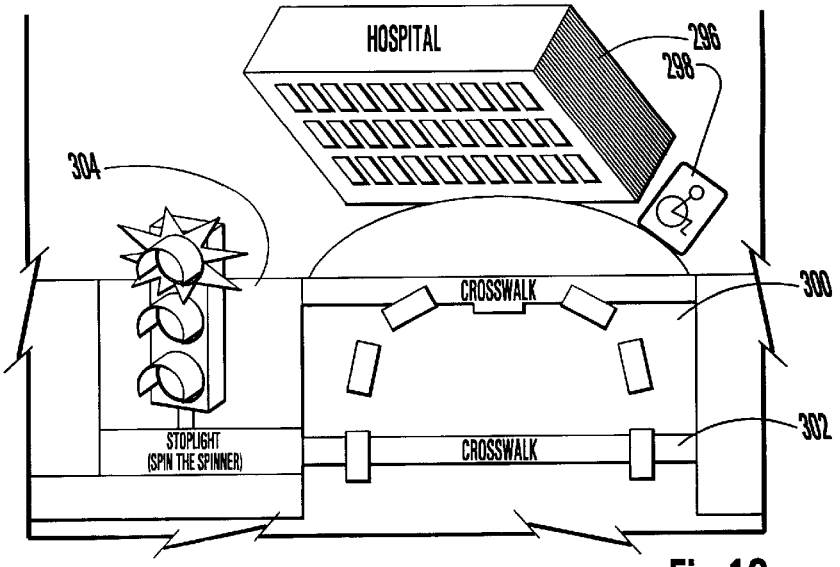
FIG. 19 is a plan view of a section of an environs domain of a board game apparatus of the invention.

In FIG. 16, 17, 18, and 19 are shown illustrations that can be displayed as particulars which are suitable for an environs domain. In FIG. 16 and 17 there is shown respectively a representation of a school 274 and a library 276. In FIG. 18 there is shown a combination of a police station 278 plus adjacent flag-post and an adjacent fire station 280 that border a secondary street 282 (partially shown), shown in part against a colored and/or shaded background. The secondary street 282 borders a bypass route 284, verges from a perimeter street 286, and intersects a journey path 288 (partially shown). Also shown in FIG. 18 are a crossing-guard stop-or-go security space 287 immediately preceding the intersection of the secondary street 282 with a journey path 288, a curb area 290 between the journey path 288 and the perimeter street 286, a "crossed-between crosswalk lines" safe behavior space 292 immediately following the intersection of the secondary street 282 with the journey path 288, and a one-way sign representation 294 adjacent the secondary street 282. In FIG. 19 there are shown illustrations of a grouping of a hospital 296, a wheelchair representation 298, a curved driveway 300 traversed by a pair of crosswalk lines 302, and an adjacent stoplight-containing stop-or-go security space 304. These representations, alone or in combination, can for instance be alternatives or substitutes for the environs domain particulars shown in FIG. 1.

Figure 20:
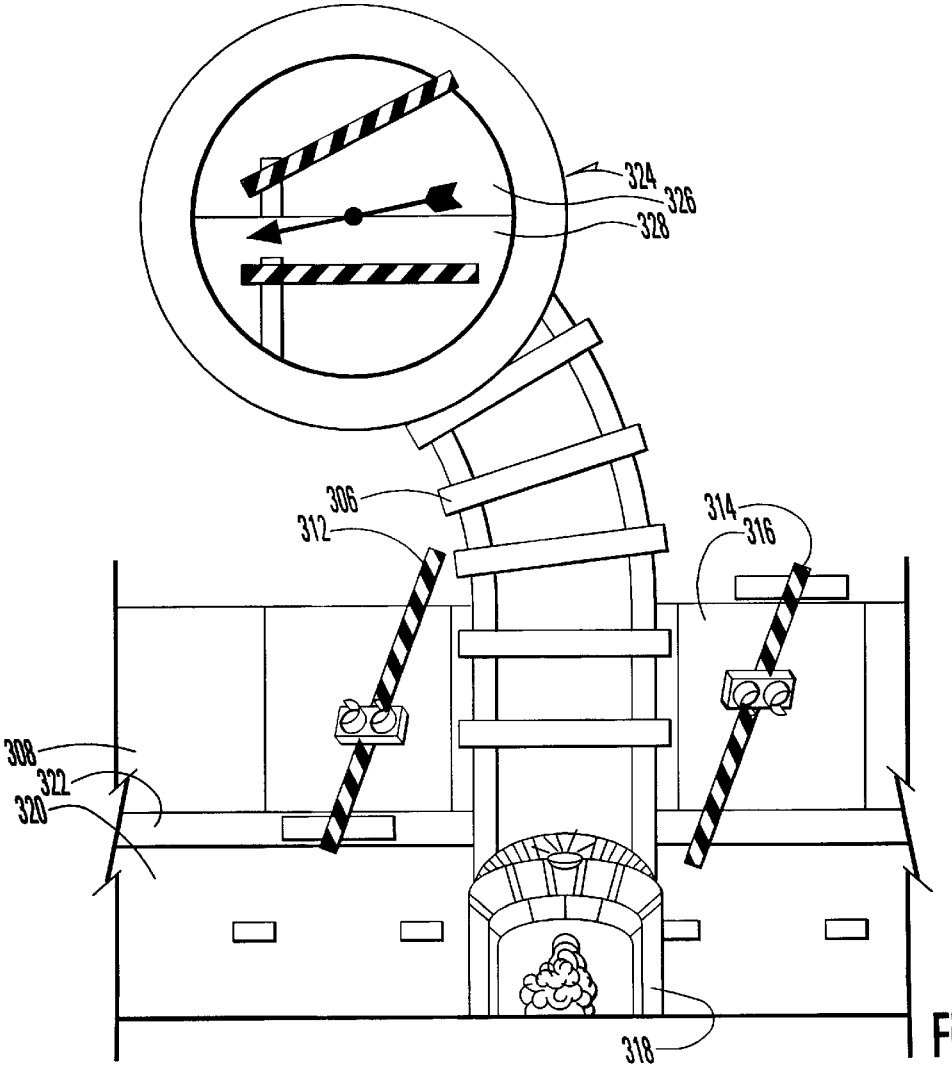
FIG. 20 is a plan view of a hedged hazard region of a board game apparatus of the invention.

In FIG. 20 there is shown a graphic representation that includes a hedged hazard region comprised of a rail road track hedged-hazard space 306 that intersects a journey path 308 immediately following a stop-or-go security space 310. A first railroad crossing gate illustration 312 lies partly within the stop-or-go security space 310, and a second railroad crossing gate illustration 314 lies partly within the journey-path space 316 following the hedged-hazard space 306. The grouping shown in FIG. 20 further includes an illustration of the forward portion of a rail road engine 318 shown in a traverse position with respect to a perimeter street section 320 which borders a curb area 322. The end of the rail road track hedged-hazard space 306 opposite the engine 318 meets a stop-or-go spinner 324 that includes a third crossing gate 326 in the up position and a fourth crossing gate 328 in the down position.

Figure 21:
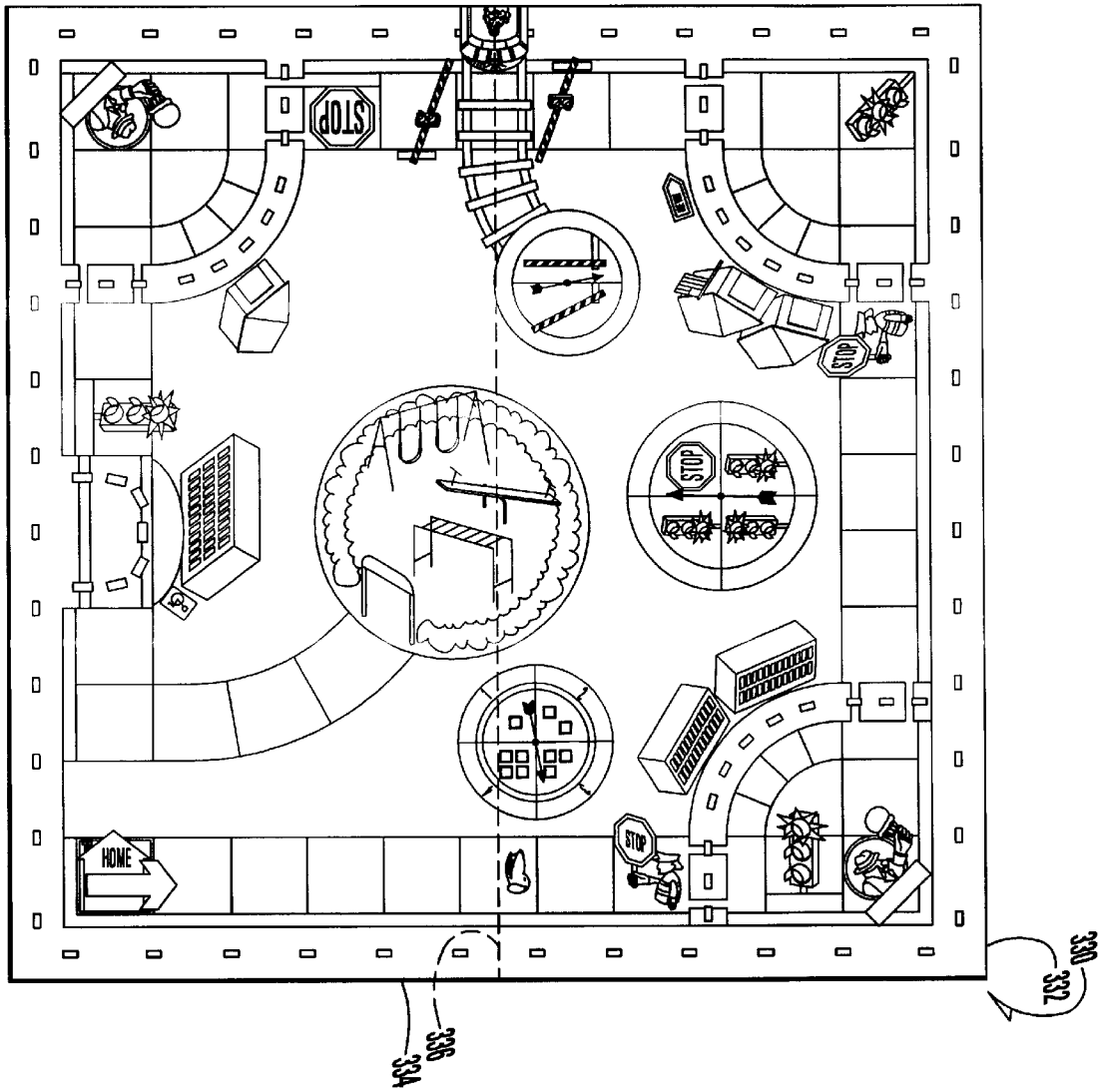
FIG. 21 is a plan view of a game board of a board game apparatus of the invention

In FIG. 21 there is shown a game board 330 having a bisecting fold line 336 that divides the board 330 into a first and a second half 332, 334. The first and the second half 332, 334 can be folded one onto the other for easy storage.

The present invention in broad embodiment is board game apparatus for instructing game participants on safety rules and regulations comprising a game board, at least one game marker, at least one marker-movement chance means and at least one stop-or-go chance means. The game board has a playing surface, which can be its upper surface, that has a plurality of domains delineated at least by outline demarcations. The domains include at least one hazard domain and at least one journey domain. The journey domain is comprised of a succession of spaces having a beginning and an end. The hazard domain comprises a hedged-hazard region that includes at least one hazard space immediately preceded by a stop-or-go security space that contains a representation of a stop-or-go safety regulation. The present invention also includes a board game apparatus wherein the game board is a substantially rigid member that is foldable and wherein the playing surface is substantially flat. The present invention also includes a board game apparatus wherein the game board is a section of a box, and wherein such box preferably has sufficient dimensions to hold the board game components. The present invention also includes a board game apparatus wherein at least one of the domains is distinguished by location, configuration, color and/or a representation at least partially encompassed within the domain. The present invention also includes a board game apparatus wherein the domains include at least one environs domain and at least one chance means domain.

The present invention also includes a board game apparatus wherein the hazard domain includes at least one neighboring hazard region and at least one intersecting hazard region. The game board has a plurality of intersecting hazard regions, an embarkment domain and a destination domain. The embarkment and destination domains are bridged by the journey domain which includes a plurality of spaces. The journey domain includes at least one bypass route that circumvents at least one of the intersecting hazard regions.

The present invention also includes a board game apparatus wherein the hazard domain includes at least one neighboring hazard region forming at least a partial perimeter border of the game board, wherein the game board has at least one avoidable hazard region, at least one bare hazard region and at least one safe behavior region, wherein the game board has an embarkment domain and a destination domain bridged by the journey domain, wherein the journey domain includes a plurality of spaces that include at least one bypass route that circumvents the avoidable hazard region, and wherein the bypass route is comprised of more spaces than the route of the avoidable hazard region.

In alternate embodiment the present invention is a board game apparatus for instructing game participants on safety rules and regulations comprising a game board having a playing surface that bears representations of at least one neighboring hazard region at least partially bordering a plurality of spaces that form a path between a representation of an embarkment area and a representation of a destination area, the path being intersected by at least one bare hazard region, at least one avoidable hazard region and at least one hedged-hazard region that includes at least one hazard space immediately preceded by a stop-or-go security space. The path includes a bypass route that circumvents the avoidable hazard region. The stop-or-go security space contains a representation of a stop-or-go safety regulation. The apparatus also includes at least one game marker, at least one marker-movement chance means and at least one stop-or-go chance means.

The present invention also includes a board game apparatus wherein at least one of the marker-movement chance means and the stop-or-go chance means is mounted on the board game. The present invention also includes a board game apparatus wherein the neighboring hazard region is comprised of a representation of a plurality of streets, wherein the hedged-hazard space includes a representation of a street that meets at least one of the streets of the neighboring hazard region, wherein the stop-or-go security space includes a representation of a stop sign, a stop light and/or a crossing guard, and wherein the stop-or-go chance means includes the representations of a red traffic light and a green traffic light when the stop-or-go security spaced includes a representation of a stop light. The present invention also includes a board game apparatus wherein the board game is substantially square, the neighboring hazard region is comprised of representations of four streets each separately disposed along an edge of the game board and each intersecting another in a corner of the game board, wherein the hedged-hazard space includes a representation of a curved street that bridges a corner of the game board and begins at one of the streets of the neighboring hazard region, ends at one of the streets of the neighboring hazard region and intersects the path whereby a street intersection hazard is formed, wherein the stop-or-go security space immediately precedes the street intersection hazard and comprises therewith the hedged hazard region, wherein the stop-or-go security space includes a representation of a stop sign, a stop light and/or a crossing guard, and wherein the stop-or-go chance means includes the representations of a red traffic light and a green traffic light when the stop-or-go security spaced includes a representation of a stop light. The present invention also includes a board game apparatus wherein the board game is substantially square, the neighboring hazard region is comprised of a first, second, third and fourth representation of a street each separately disposed along an edge of the game board and each intersecting another in a corner of the game board, wherein the game board includes at least a first, second and third hedged hazard region, wherein the first and the second hedged-hazard regions are each comprised of a hedged-hazard space formed by a curved street that bridges a corner of the game board and begins at one of the streets of the neighboring hazard region, ends at one of the streets of the neighboring hazard region and intersects the path, wherein the stop-or-go security spaces of the first and the second hedged-hazard regions each separately include a representation of a stop sign, a stop light and/or a crossing guard, wherein the third hedged-hazard region is comprised of a hedged-hazard space that includes a representation of railway track and a stop-or-go security space that includes the representation of a crossing guard rail, wherein the game board further includes a representation of a curved driveway that intersects the path, and wherein the game board includes the representation of a cross walk that extends across at least one of the curved street and the curved driveway at the intersection of the curved street or the curved driveway with the path. The present invention also includes a board game apparatus wherein the game board further includes a safe behavior region. The present invention also includes a board game apparatus wherein the game board further includes an environs domain comprising a representation of a school, a representation of a library, a representation of a police station, a representation of a hospital or a representation of a fire station or combinations thereof. The present invention also includes a board game apparatus wherein the embarkment area includes a representation of a home and the destination area includes a representation of a park. The present invention also includes a board game apparatus wherein the first representation of a street is designated Home Avenue and the embarkment area is located adjacent the first representation of a street.

The present invention also includes a method of using the board game apparatus described above comprising the steps of: (1) placing the game marker on the playing surface of the game board adjacent the beginning of the journey domain; (2) operating the marker-movement chance means to determine the number of spaces the marker should be moved; (3) moving the marker along the succession of spaces for the number of spaces determined in step 2 or until the safety-regulation space is reached, whichever move covers the least number of spaces; (4) operating the stop-or-go chance means to determine whether a stop or a go direction is obtained; (5) if a go direction is obtained in step (4), repeating steps (2) and (3); and (6) if a stop direction is obtained in step (4), waiting an interval and then repeating step (4).

The present invention also includes such a method wherein the game board has at least one avoidable hazard region and the succession of spaces includes a direct route intersected by the avoidable hazard region and a longer detour route that bypasses the avoidable hazard region, further including the additional steps of: (7) while performing step (3), selecting either the direct route or the longer detour route along which the marker is moved and (8) if the direct route was selected in the selection of step (7) and the movement for the number of spaces determined in step (2) lands the marker on the avoidable hazard space, taking a penalty provided for the avoidable hazard space.

The present invention also includes such a method wherein the penalty provided for the avoidable hazard space is the movement of the marker backwards a certain number of spaces.

One or more secondary tactile objectives, such as the accumulation or retention of points as rewards, and/or the loss of points as penalties, during the play are not excluded and may overlay the primary tactile objective. The rules may provide that the secondary tactile objective(s) are fixed or are elective.

The game may be devised to permit competitive play between a plurality of participants and/or be structured for play by a single player.

We claim:

1. A board game apparatus for instructing game participants on safety rules and regulations comprising:

a game board having a playing surface, said playing surface being divided by at least outline demarcations into a plurality of domains, said domains including at least one hazard domain, at least one journey domain, an embarkment domain and a destination domain, said journey domain bridging said embarkment domain and said destination domain and being comprised of a succession of spaces beginning at said embarkment domain and ending at said destination domain, said journey domain having at least one hedged-hazard space and at least one stop-or-go space, said stop-or-go space immediately preceding said hedged-hazard space, said journey domain having at least one avoidable hazard space, said journey domain having a detour route bypassing said avoidable hazard space, said detour route being comprised of more of said spaces of said journey domain than the route through said avoidable hazard space, said hazard domain being comprised of at least a first neighboring hazard region and an intersecting hazard region, said intersecting hazard region emanating from said first neighboring hazard region, said first neighboring hazard region being a representation of a hazard bordering a first segment of said journey domain, said intersecting hazard region intersecting said journey domain at said first hedged-hazard space, wherein said stop-or-go space contains a representation of a stop-or-go safety regulation;

at least one game marker;

at least one marker-movement chance means; and at least one stop-or-go chance means.

2. The board game apparatus of claim 1 wherein said game board is a substantially rigid member that is foldable and wherein said playing surface is substantially flat.

3. The board game apparatus of claim 1 wherein said game board is a component of a box.

4. The board game apparatus of claim 1 wherein at least one of said domains is distinguished by its location, configuration, color and/or a representation at least partially encompassed within said domain, said hazard domain further including a second neighboring hazard region, said second neighboring hazard region being a representation of a hazard bordering a second segment of said journey domain, said first and second neighboring hazard regions each separately being a representation of a perimeter street, said intersecting hazard region being a representation of a curved secondary street extending between said first and second neighboring hazard region, and said stop-and-go space containing a representation of a traffic light, a stop sign, or a crossing guard.

5. The board game apparatus of claim 4 wherein said domains include at least one environs domain containing representations of urban structures and at least one chance means domain containing a game spinner.

6. The board game apparatus of claim 4 wherein said perimeter street representations form at least a partial perimeter border of said game board, and wherein said journey domain has at least one bare hazard space and at least one safe behavior space.

7. A board game apparatus for instructing game participants on safety rules and regulations comprising:

a substantially square game board having an upper playing surface that has a plurality of spaces that form a path between a representation of an embarkment area and a representation of a destination area located within a border area formed by representations of four streets each separately disposed along an edge of said game board and each intersecting another in a corner of said game board, said path including a first hazard space immediately preceded by a stop-or-go space, said path including a second hazard space and a bypass route that circumvents said second hazard space, wherein said first hazard space is part of a representation of a secondary street emanating from one of said streets in said border area and said stop-or-go space contains a representation of a traffic light, stop sign or crossing guard;

at least one game marker;

at least one marker-movement spinner mounted on said game board; and at least one stop-or-go spinner mounted on said game board.

8. The board game apparatus of claim 7 wherein said secondary street representation is a representation of a curved street that bridges a corner of said game board and begins at one of said streets of said border area, ends at another one of said streets of said border area and intersects said path at said first hazard space whereby a street intersection hazard representation is situated at said first hazard space, and wherein said stop-or-go spinner has representations of a red traffic light and a green traffic light when said stop-or-go space has a representation of a stop light.

9. The board game apparatus of claim 7 wherein said path further includes a third hazard space containing a representation of railway track immediately preceded by a stop-or-go space that contains a representation of a crossing guard rail and said game board further includes a stop-or-go spinner having representations of crossing guard rails in the up and in the down position, and said path further including a plurality of adjacent hazard spaces containing in combination a representation of a curved driveway that emanates from one of said streets of said border area.

10. The board game apparatus of claim 8 wherein said game board further includes an environs domain containing a representation of a school, a representation of a library, a representation of a police station, a representation of a hospital or a representation of a fire station or combinations thereof, wherein said embarkment area contains a representation of a home and said destination area contains a representation of a park, and said embarkment area is adjacent one of said streets in said border area, and said street adjacent said embarkment area includes a representation of a street sign labeled Home Avenue.

11. A method of playing a game that instructs at least one game participant about safety rules and regulations using the board game apparatus of claim 1 comprising the steps of:

providing a game board having a playing surface, said playing surface being divided by at least outline demarcations into a plurality of domains, said domains including at least one hazard domain, at least one journey domain, an embarkment domain and a destination domain, said journey domain bridging said embarkment domain and said destination domain and being comprised of a succession of spaces beginning at said embarkment domain and ending at said destination domain, said journey domain having at least one hedged hazard space and a stop-or-go space, said stop-or-go space immediately preceding said hedged-hazard space, said journey domain having at least one avoidable hazard space, said journey domain having a detour route bypassing said avoidable hazard space, said detour route being comprised of more of said spaces of said journey domain than the route through said avoidable hazard space, said hazard domain being comprised of at least a first neighboring hazard region and at least one intersecting hazard region emanating from one of said first neighboring hazard region, said neighboring hazard region being a representation of a hazard bordering a segment of said journey domain, said intersecting hazard region intersecting said journey domain at said first hedged-hazard space, wherein said stop-or-go space contains a representation of a stop-or-go safety regulation;

providing at least one game marker;

providing at least one marker-movement chance means;

providing at least one stop-or-go chance means;

starting the game by placing said game marker on said playing surface of said game board in said embarkment domain;

repeatedly determining the number of said spaces to move said marker along said journey domain by operating said marker-movement chance means;

repeatedly moving said marker along said succession of spaces for the number of spaces determined by operating said marker-movement chance means except (a) stopping said marker on said stop-or-go space when reached and losing any spaces not moved, and (b) following the immediately following step when stopped on said stop-and-go space, when stopped on said stop-and-go space, repeatedly operating said stop-or-go chance means until a go direction is obtained, and then repeatedly operating said marker-movement chance means until a movement of more than one space is indicated;

making an election between said detour route or said route through said avoidable hazard space when their intersection is reached;

taking a penalty if said marker stops on said avoidable hazard space; and if there are more than one game participant, each of said participants taking turns in sequence, each of said turns comprising (a) no more than a single operation of said marker-movement chance means plus the marker movement permitted thereby and any movement backwards required by a penalty or (b) a single operation of said stop-or-go chance means when a stop indication is obtained therefrom.

12. The method of claim 11 wherein said penalty provided for said avoidable hazard space is the loss of a turn.

13. The method of claim 11 wherein said penalty provided for said avoidable hazard space is the movement of the marker backwards a certain number of spaces.

* * * * *